US005612156A

United States Patent [19]

Murasawa et al.

[11] Patent Number: 5,612,156

[45] Date of Patent: Mar. 18, 1997

[54] ELECTROPHOTOGRAPHIC PHOTOSENSITIVE ELEMENT AND A PROCESS FOR MANUFACTURING AN OFFSET PRINTING MASTER FROM THE ELEMENT

[75] Inventors: Sadao Murasawa, Itami; Mitsuru Watanabe, Moriyama, both of Japan

[73] Assignee: Ishihara Sangyo Kaisha, Ltd., Osaka, Japan

[21] Appl. No.: 115,781

[22] Filed: Sep. 3, 1993

Related U.S. Application Data

[62] Division of Ser. No. 573,264, Aug. 27, 1990, abandoned, which is a continuation of Ser. No. 371,079, Jun. 26, 1989, abandoned.

[30] Foreign Application Priority Data

Jun. 27, 1988 [JP] Japan ..... 63-158260

[51] Int. Cl.[6] ..... G03G 13/28; G03G 15/08; G03G 13/20

[52] U.S. Cl. ..... 430/49; 430/88; 430/124

[58] Field of Search ..... 430/49, 88, 124

[56] References Cited

U.S. PATENT DOCUMENTS

| | | | |
|---|---|---|---|
| 3,001,872 | 9/1961 | Kurz | 96/1 |
| 3,458,310 | 7/1969 | Arneth et al. | 430/49 X |
| 3,522,062 | 7/1970 | Shimizu . | |
| 3,592,640 | 7/1971 | Van Engeland et al. | 96/1 |
| 3,736,134 | 5/1973 | Gosselink et al. | 430/89 X |
| 3,745,002 | 7/1973 | Honjo et al. | 430/49 |
| 3,758,330 | 9/1973 | Richman | 430/49 |
| 3,941,594 | 3/1976 | Honjo et al. | 430/84 X |
| 4,034,671 | 7/1977 | Bach | 428/909 X |
| 4,081,572 | 3/1978 | Pacansky | 430/300 |
| 4,121,931 | 10/1978 | Nelson | 430/120 |
| 4,418,134 | 11/1983 | Patel . | |
| 4,565,759 | 1/1986 | Tsutsui | 430/66 |
| 4,880,716 | 11/1989 | Kato et al. | 430/49 |
| 5,019,484 | 5/1991 | Shimaoka et al. | 430/293 |

FOREIGN PATENT DOCUMENTS

| | | | |
|---|---|---|---|
| 0715500 | 8/1965 | Canada | 430/89 |
| 0958266 | 11/1974 | Canada | 430/58 |
| 2110005 | 5/1972 | France . | |
| 47-029117 | 7/1972 | Japan . | |
| 49-011595 | 3/1974 | Japan . | |
| 50-036768 | 11/1975 | Japan . | |
| 50-040016 | 12/1975 | Japan . | |
| 51-049213 | 12/1976 | Japan . | |
| 53-74428 | 7/1978 | Japan . | |
| 0072150 | 6/1982 | Japan | 430/84 |
| 58-040177 | 9/1983 | Japan . | |
| 59-019330 | 5/1984 | Japan . | |
| 63-018743 | 4/1988 | Japan . | |
| 1367294 | 9/1974 | United Kingdom . | |
| 2103818 | 2/1983 | United Kingdom . | |

OTHER PUBLICATIONS

Hackh's Chemical Dictionary, 4th Edition, Editted by Grant, p. 682.

Hawley's Condensed Chemical Dictionary, 10th Edition, p. 1026.

*Primary Examiner*—George F. Lesmes
*Assistant Examiner*—Bernard P. Codd
*Attorney, Agent, or Firm*—Cushman, Darby & Cushman IP Group of Pillsbury Madison & Sutro LLP

[57] ABSTRACT

An electrophotographic photosensitive element for use in offset printing masters comprises an electrically conductive support having an photosensitive layer formed thereon where said layer comprises titanium dioxide and zinc oxide in a specific amount of zinc oxide based on the total amount of titanium dioxide and zinc oxide and a method for manufacturing the masters from the elments by subjecting the same to charging, exposure, development and lipophobicating treatment.

4 Claims, 1 Drawing Sheet

ELECTROPHOTOGRAPHIC PHOTOSENSITIVE ELEMENT AND A PROCESS FOR MANUFACTURING AN OFFSET PRINTING MASTER FROM THE ELEMENT

This is a division of application Ser. No. 07/573,264, filed on Aug. 27, 1990, which was abandoned upon the filing hereof; which is a continuation of Ser. No. 07/371,079 filed Jun. 26, 1989, now abandoned.

BACKGROUND OF THE INVENTION

1. Field of the Invention

The present invention relates to an electrophotographic photosensitive element suitable to production of a printing plate for use in lithographic offset printing (referred to as offset printing hereinunder) and a process for producing the printing plate (referred to as a master hereinunder).

2. Description of Related Art

In the conventional simple printing techniques suitable to produce a smaller amount of prints with a number of plates, printing masters are generally manufactured by the so-called direct processing of block plates through an electrophotographic process and used to perform offset printing as is well known in the art. Since such techniques can produce relatively easily and rapidly printed materials, they have been widely employed. Recently, in view of both quality and quantity, the simple printing techniques have found greatly increasing use in a wide variety of printings such as commercial printings of bills, catalogs and brochures as well as conventional plain printings of leaflets and various documents in the firms. With such an increase of demand and a tendency to diversity, there is a commercial need to further improve the quality of printings and to increase the speed of printing. A variety of methods for manufacturing the masters by using the electrophotographic process have been known. One of the most widely used methods comprises providing zinc oxide powder as a photoconductor, dispersing said powder into an insulating binder resin to produce a coating dispersion, applying the dispersion onto an electrically conductive substrate and drying the same to produce a photosensitive element. Generally, the element is successively subjected to electrically charging, exposure imagewise to the light through the original to produce latent image and development of the latent image with toner to produce a plate having a toner pattern on the photosensitive layer. The plate having the toner pattern (referred to as a developed plate hereinunder) is processed with a desensitizing agent to render the non-image portions lipophobic (referred to as a lipophobicating agent hereinunder), whereby a master is produced.

Zinc oxide widely used as photoconductor as described above is generally sensitized primarily with xanthene dyes. In this case, the photosensitive elements are colored with the sensitizing dyes to be the so-called pink master sheets which are widely employed. The pink master sheets, however, have a poor smoothness on the level of the top surfaces (in the image area ), a poor granularity, a lower tendency to produce sharp image printings, and a lower resistance to printing abrasion with a mass production of printings being impractical. Moreover, the pink master sheets are difficult to inspect, that is, to effect the so-called plate-inspection due to their coloration and calls for particular care in modification and editing of the original. As above, the current electrophotographic processes for producing printing plates and techniques for manufacturing the masters in the field of printings are in need of improvement.

SUMMARY OF THE INVENTION

It is an object of the present invention to provide an electrophotographic photosensitive element for use in production of offset printing masters and a method for manufacturing more conveniently the masters capable of efficiently producing copies of images having a high quality by directly processing the element with the aforementioned problems being solved and the aforementioned commercial demands being satisfied.

DETAILED DESCRIPTION OF PREFERRED EMBODIMENT

Figure 1:
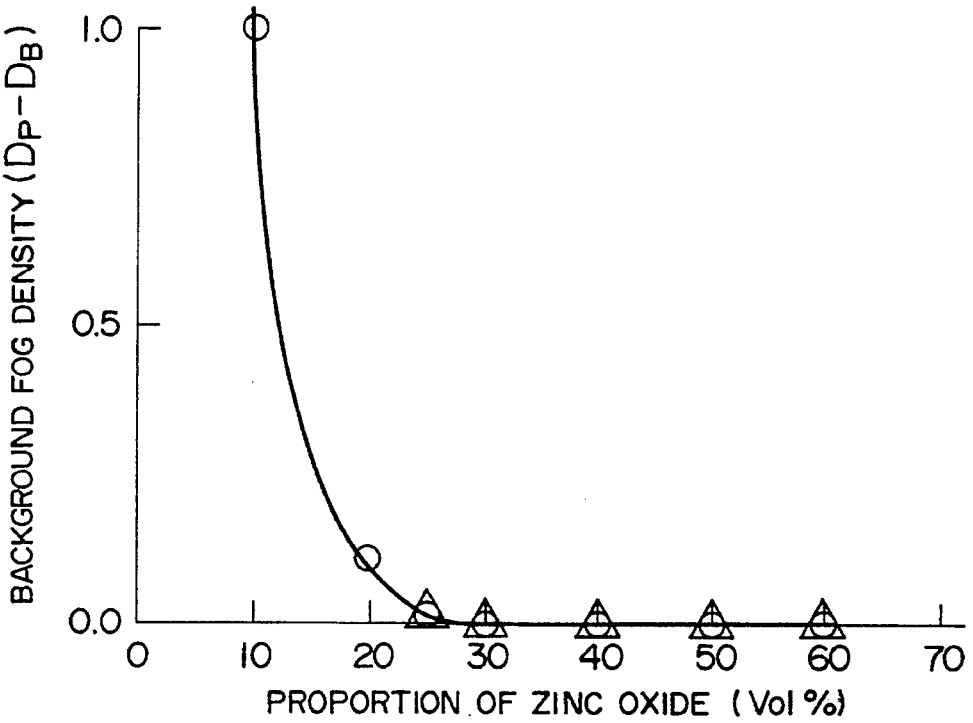
FIG. 1 is a plot of the fog density of the printings produced with the masters made using the photosensitive material of the present invention and that of the Comparative Example versus the proportion of zinc oxide to be mixed.

For many years, we have been engaged in research and development of the method for manufacturing printing plates by the electrophotographic process using titanium dioxide as photoconductor in place of zinc oxide. The use of a selected titanium dioxide together with suitable binder resins and various adjuvants enable production of an electrophotographic photosensitive element having more excellent electrophotographic properties, from which a developed plate having a sharp and clear image of high resolution thereon can be produced. We attained to an idea that if the developed plate could be etched with a lipophobicating agent to render the non-image portion lipophobic, a printing plate could be directly produced from the element, that is, a direct production of plates could be realized. We made an attempt to make the non-image portion hydrophilic by applying any of a number of commonly used lipophobicating agents, but found that the attempt was unsuccessful probably owing to the fact that titanium dioxide is chemically much more stable as compared with zinc oxide. Furthermore, we have studied extensively seeking any agents suitable for lipophobicating the photosensitive element having the titanium dioxide layer as photoconductor. No desired agent has been attained since the lipophobicating agents capable of making the non-image portion hydrophilic are less resistant to printing wear far from giving a desired master.

The present invention is based on the incidental finding that the photosensitive element having the titanium dioxide layer as photoconductor can be rendered hydrophilic with conventional lipophobicating agents, if such a small amount of zinc oxide as substantially not lowering the quality of image is present in the layer. Then, an extensive reseach has been made in development of a photosensitive element, from which a master capable of efficiently producing high quality prints can be manufactured. The present invention has been achieved by success in such development.

In the first aspect of the present invention, there is provided an electrophotographic photosensitive element for use in offset printing masters comprising an electrically conductive support having a photosensitive layer thereon characterized in that said layer comprises titanium dioxide and zinc oxide as photoconductors in a proportion of 20 to 55% by volume of zinc oxide based on the total amount of titanium dioxide and zinc oxide. Embodiments of the first aspect of the present invention will be described later. In the second aspect of the present invention, there is provided a method for manufacturing the masters.

It is unexpectedly surprising that an addition of a small amount of zinc oxide as described above can lead to imparting the desired hydrophilic property on the non-image portion through application of conventional lipophobicating agents to the developed plate, particularly that a proportion of about 20% or higher of zinc oxide to be incorporated allows sharply effective lipophobication and that even a relatively large amount of zinc oxide to be added allows the image of an excellent quality to withstand the lipophobicating process with the printing image retaining good printing characteristics.

With regard to electrophotographic photosensitive elements, it has been well known that titanium dioxide may be incorporated into zinc oxide photosensitive layers, or inversely zinc oxide into titanium dioxide layers, as described, for example, in Japanese Patent Publication No. Sho 49-11595 (titanium dioxide is added for the purpose of controlling the reproducibility of gradation of the zinc oxide photosensitive layer), Japanese Patent Publication No. Sho 50-36768 (titanium dioxide is added for the purpose of enhancing the positively charging property of the zinc oxide photosensitive layer), Japanese Patent Publication No. Sho 50-40016 (titanium dioxide is added for the purpose of reducing the fog of the zinc oxide photosensitive layer sensitized with dyes) and Japanese Patent Publication No. Sho 51-49213 (metal oxides such as zinc oxide and barium oxide are added for the purpose of improving the moisture-proofing property of the titanium dioxide photosensitive layer). However, none of those patents makes mention of utilizing such photosensitive materials for production of printing masters.

Examples of titanium dioxide to be used in the present invention include those commonly employed in electrophotography. Those may be produced by various processes. For example, in order to produce titanium dioxide, titanium sulfate, titanium tetrachloride or organic titanium compounds in solution may be hydrolyzed, in the presence of seeds if necessary, to precipitate titanium dioxide hydrate which is calcined, or titanium tetrachloride may be decomposed in vapor phase through oxidation, or ammonium titanyl sulfate may be thermally decomposed. In case the titanium dioxides are of rutile type crystalline, the present invention will have a more increased utility. The electrophotographic properties of the titanium dioxides to be produced by any of the aforementioned processes may be preferably modified by conducting the generation and growth of crystalline titanium dioxide in the presence of one or more metal components such as Zn, Li, Mg, Ba, Sr and the like during the processes. With regard to the processes for producing the titanium dioxides for use in electrophotography and the metal components for improving the electrophotographic properties of the titanium dioxides, reference may be made to the disclosures of Japanese Patent Publication No. Sho 47-29117 and Japanese Patent Publication No. Sho 58-40177. As zinc oxide, one may mention those, photoconductive or non-photoconductive, which may be produced by various processes such as the so-called indirect process using vapor phase oxidation, or the so-called direct process producing directly from zinc ores. As insulating binder resins for forming the photosensitive layer having titanium dioxide and zinc oxide dispersed therein, a wide variety of resins may be employed. Examples of the resins include acrylic resins, alkyd resins, polyester resins, vinyl resins, silicone resins, amino resins, and the like which may be used alone or in combination. As electrically conductive supports, a variety of materials may be employed. Examples of the electrically conductive supports include electroconductive material-coated papers, metal-deposited artificial sheets or plastic films, metal-laminated papers or plastic films, metal sheets and the like.

According to the present invention, the electrophotographic photosensitive element for use in offset printing masters may be manufactured by dispersing predetermined amounts of titanium dioxide and zinc oxide into a insulating binder resin solution usually in an proportion of 25 to 65% by volume of the oxides based on the solids in the resin solution to produce a coating dispersion, coating the dispersion onto an electrically conductive support usually in a thickness (as dried film thickness) of 5 to 25 μm and drying the film of dispersion to form an photosensitive layer. Titanium dioxide and zinc oxide may be seperately added and mixed into the resin solution, or both may be premixed and then added into the resin solution, when the dispersion is prepared. The amount of zinc oxide in the photosensitive layer is 20 to 55%, preferably 20 to 50%, more preferably 25 to 40% by volume based on the total amount of titanium dioxide and zinc oxide. If the amount of zinc oxide in the photosensitive layer is too low, the lipophobicating treatment can not impart to the non-image portions a stable hydrophilic property so that the prints tend to have tinted background and sharp prints can not be obtained. If the amount of zinc oxide is too high, the image portion of the master is apt to deteriorate so that the reproducibility in configuration of the dots of the master relative to those of the original is lowered resulting in reduction of the quality of the prints and that the durability in printing of the master tends to decline.

In order to improve electrophotographic properties such as photosensitivity, speed of electrification, retention of charge in dark, resistance to wet deterioration of the photosensitive element of the present invention as well as to enhance the durabilities in water and in printing of the master made from the element, various improving agents or improving processes may be applied. Examples of the agents include cyanine, xanthene, phthalein, triphenylmethane, oxazine, thiazine, anthraquinone dyes and the like, which may be employed alone or in combination if desired, as sensitizers in respective specific regions of spectral wavelengths. Among them, more preferable ones are cyanine compounds having at least one group selected from a group consisting of carboxyl, sulfonyl and hydroxyalkyl groups and having three or more of methine groups. Similar sensitization with dyes may apply to zinc oxide. For further enhancing the sensitizing effect of the sensitizers, treatments with nitrogen-containing cyclic compounds such as phenidone will be feasible. Descriptions about these sensitizers (including phenidone) can be found in, for example, Japanese Patent Publication Nos. Sho 59-19330 and Sho 63-18743. Agents for improving the retention of charge in dark which may be used include, for example, metallic soaps, silane coupling reagents, amines, organic acids, alcohols having six or more carbon atoms and the like. Stabilizers for charging properties to be used as preventing the photosensitive layer from being adversely affected by environmental moisture and the like include, for example, various organic fluoro-compounds and organic acids such as gallic acid, methacrylic acid, phthalic acid, pyromellitic acid and anhydrides thereof. Such stabilizers for charging properties are disclosed, for example, in Japanese Patent Laid-open No. Sho 53-74428. These various improving agents may be added when titanium dioxide and zinc oxide are mixed and dispersed in a binder resin solution to produce a coating solution. Alternatively the addition of them may be effected by other various methods. For example, the improving agents may be preliminarily adsorbed or absorbed on the surfaces of titanium dioxide particles which are then dispersed into the binder resin solution. If necessary, the preliminary process may be carried out under heating to attach more intimately on the surfaces of the particles whereby the effects of the present invention may be made more outstanding. The photosensitive elements of the present invention are subjected to a lipophobicating agent at the time of preparing the masters. Generally damping water is used upon printing to sustain the lipophobicating effect. Therefore, the element must have a higher water-resisting property and for the purpose of enhancing the property may be modified by providing a primary layer comprising, for example, a water soluble resin rendered water-resistant by amino resin between the photosensitive layer and the support.

From the thus produced photosensitive element of the present invention, the master is usually manufactured by the follwing procedure: First the top surface of the photosensitive layer of the element is uniformly charged. Then the surface of the photosensitive layer is exposed imagewise to the light through the original and thereafter developed with a developer of the liquid or powder type to produce a developed plate. Then the surface of the developed plate is treated with a lipophobicating agent. A variety of lipophobicating agents may be employed. For example, any of widely used lipophobicating agents such as phytic acid, ferrocyanic dyes and the like in solution may be applied to the surface of the plate by damping with or immersing in the solution to impart a hydrophilic property to the non-image protions of the surface of the plate. In this way the desired master can be obtained.

Recently, in the field of offset printing with masters manufactured by directly processing plates through electrophotographic process, there is a need for elements having much higher performance and speed as well as an increasing demand and a tendency to diversity as described above. In order to meet those needs in the market, there has been already made an attempt of direct process where the developed plates produced by the electrophotographic technique are used as block copies and edited by patching up to produce the second original. There is also proposed a direct process using laser in place of the conventional halogen lamp as light source. Moreover, there is investigated an entirely automatic system comprising a direct plate-processing device in connection with an offset printing machine to produce colored prints.

Figure 2:
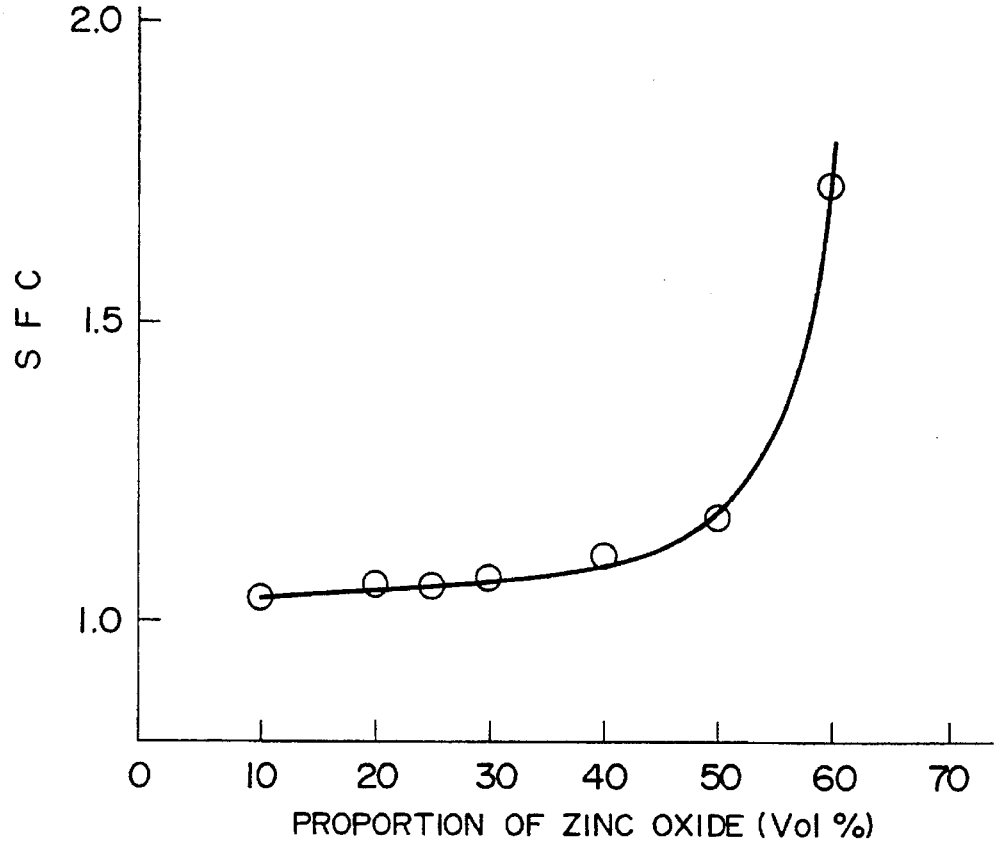
FIG. 2 is a plot of the reproducibility of dots on the masters relative to those of the original versus the proportion of zinc oxide to be mixed, said masters being made using the photosensitive material of the present invention and that of the Comparative Example (wherein Δ=after 10,000 sheets printed; o=after 100 sheets printed).

Under these circumstance, the present invention is paticularly useful. The masters made from the widely used photosensitive elements with conventional zinc oxide as photoconductor have a high degree of coloration, a low smoothness of the surfaces (in the image area), a poor reproducibility of dots relative to those of the original and an inferior granularity of the image. In contrast, according to the present invention, there can be produced masters having a higher whiteness and a higher smoothness. In addition, the masters according to the present invention can be easily inspected. Thus, the present invention allows the production of masters including modification and arrangement of the block copies to be more easily conducted. As a result, particularly when the photoconductor has been sensitized with dyes to have higher sensitivities to the spectrum in the range from near infrared to infrared wavelengths, the masters become more preferred. The masters have a high reproducibility of dots as shown in FIG. 2, an excellent granularity of the image and a superior resistance to printing abrasion. Moreover, the use of the masters can produce prints having no background fog as shown in FIG. 1. By subjecting the masters to the offset printing machine, therefore, one may produce copies of a high resolution having sharp and clear image printed. This effects become preferably more remarkable when the masters are prepared from the developed plates with liquid developers. In this way, the present invention leads to the efficient and prompt production of high quality printings so that it can apply not only to the conventional simple printing techniques, but also to the mass production techniques in the commercial printing field. In addition, the present invention may be applied to such a field of application where especially masters having an excellent performance are required.

The present invention will be further illustrated with reference to Examples and Comparative Examples hereinunder.

EXAMPLES 1 to 5

In Examples, there was used the follwing composition containg a powdery mixture of titanium dioxide and zinc oxide with varying proportions of zinc oxide being incorporated as shown in Table 1:

| | |
|---|---|
| Powdery mixture of titanium dioxide and zinc oxide | 39 by volume |
| Styrene-acryl copolymer resin | 133 by volume |
| Toluene | 189 by volume |

The above composition was kneaded for one hour by means of the paint conditioner (available from Red Devil Co.) to produce a dispersion. This dispersion was coated onto an electroconductive substrate (electroconductive support) and dried for three minutes at a temperature of 100° C. to provide a photosensitive layer having a thickness of 15 μm.

The thus produced photosensitive elements were sequentially charged, exposed to the light through the original bearing a halftone image and developed by means of the electrophotographic offset plate processing machine, Model CPC with a liquid type of developer to produce the developed plates. The development was effected with the liquid developer for the elements (available from Itek Co.).

The developed plates were treated with commercially available lipophobicating agents (P.P Clean H, phytic acid type, available from Nikken Chemical Laboratory Co.) to obtain masters.

Using these masters, up to 10,000 sheets were printed on the offset printing machine. In this case, the damping water comprising P.P.Clean H diluted 20 times in water was employed.

COMPARATIVE EXAMPLES 1 AND 2

Masters were made as in Examples 1 to 5 except that the powdery mixtures of the proportions of titanium dioxide and zinc oxide as indicated in Table 1 were used in Comparative Examples. The masters were set on the offset machine to obtain printings.

TABLE 1

| | Proportion of incorporated zinc oxide |
|---|---|
| Example 1 | 20 |
| Example 2 | 25 |
| Example 3 | 30 |
| Example 4 | 40 |
| Example 5 | 50 |
| Comparative Example 1 | 10 |
| Comparative Example 2 | 60 |

The proportion of zinc oxide as shown in Table 1 means a proportion (%) of zinc oxide to be incorporated based on the total amount by volume of titanium dioxide and zinc oxide.

All the titanium dioxide (rutile type crystal) powder used had been sensitized continuously in the range from visible light to near infrared wavelengths by treating in a solution of cyanine dyes and xanthene dyes in ethanol.

The printings obtained in Examples and Comparative Examples were evaluated for the reflection density ($D_P$) of the non-image portions by means of the reflection densitometer Model DM-400 (avalable from DAINIPPON SCREEN Co.) and the reflection density was compared with that ($D_B$) of the original unprinted sheet which had been previously measured by the same densitometer. The difference between $D_P$ and $D_B$ is plotted in FIG. 1 as background fog density. The masters obtained in Examples and Comparative Examples were evaluated for the reproducibility of dots [SFC (Spherical Figure Complication): irregularity in peripheral configuration of dots] in the image area relative to those of the original by means of the image analyzer (SPICCA, available from Nippon Avionics Co.) where the total area of the dots comprised 30% of the image area on the surface of the master. The results are shown in FIG. 2.

It can be clearly seen from FIG. 1 that if the amount of added zinc oxide is too low, the lipophobicating effect is inferior and that the background fogging starts to occur suddenly as the proportion of zinc oxide becomes about 20% or higher. It can be also apparent from FIG. 2 that if the amount of zinc oxide to be incorporated is too lower, the reproducibility of the dots is lowered resulting in reduction of the quality of the image on the copies.

EXAMPLE 6

With photosensitive elements as in Examples 1 to 5, charging, exposure to the light through the color-separated halftone films and development are sequentially carried out in a similar manner as in Examples 1 to 5 to produce respective developed plates correspondingly to the respective color-separated halftone films. The respective plates are treated with liquid lipophobicating agents to obtain masters corresponding to the respective color-separated halftone films.

These masters are set on the offset printing machine which is then operated to perform printing repeatedly with complementary colored inks to the respective color-separated halftone films. In this way, there are produced multi-colored copies of high quality having no background fog and a superior reproducibility of dots.

EFFECTS OF THE PRESENT INVENTION

The electrophotographic photosensitive elements for use in offset printing masters of the present invention are excellent in electrophotographic properties and lipophobicating performance. The masters made from the photosensitive elements by direct processing have a higher whiteness and smoothness and make the process of manufacturing printing plates including modification and arrangement of block copies much easier. The offset printing with the masters can provide high quality prints. Therefore, the present invention allows efficient and rapid production of prints of high quality and are extremely useful in industry in that it has an increasing utility in the extensive field of application including the field of color-printing requiring masters of high quality.

What is claimed is:

1. A method for manufacturing offset printing masters comprising the steps of:

obtaining an electrophotographic photosensitive element which has an electrically conductive support having a photosensitive layer formed thereon consisting essentially of binder resin, zinc oxide, and rutile titanium dioxide, which layer contains 20 to 55% by volume of zinc oxide based on the total volume amount of rutile titanium dioxide and zinc oxide, charging the photosensitive layer in an uniform manner, exposing the charged photosensitive layer through an original having halftone image to light, treating the exposed charged photosensitive layer with a developer, and treating the developed photosensitive layer with lipophobicating agents to obtain the offset printing masters.

2. A method for manufacturing offset printing masters according to claim 1 wherein the lipophobicating agent is phytic acid or a ferrocyanide.

3. A method for manufacturing offset printing masters according to claim 1 where said exposure to light is through color-separated halftone films.

4. A method for manufacturing offset printing masters according to claim 1 wherein the developer is a liquid.

* * * * *